US005921874A

United States Patent [19]

Stockhamer

[11] Patent Number: 5,921,874

[45] Date of Patent: Jul. 13, 1999

[54] GAME DART FLIGHT GROOMING DEVICE AND METHOD

[76] Inventor: Lee Stockhamer, 1788 Horton Rd., Mohegan Lake, N.Y. 10547

[21] Appl. No.: 08/837,542

[22] Filed: Apr. 21, 1997

[51] Int. Cl.[6] ..... B26B 27/00; B26B 3/04

[52] U.S. Cl. ..... 473/569; 30/304

[58] Field of Search ..... 30/304, 305; 473/569

[56] References Cited

U.S. PATENT DOCUMENTS

| | | | |
|---|---|---|---|
| 1,360,765 | 11/1920 | Knowlton | 30/304 X |
| 3,270,368 | 9/1966 | Cook et al. | 30/304 X |
| 4,455,784 | 6/1984 | Gallo | 30/304 X |
| 4,472,879 | 9/1984 | Sizemore | 30/304 |

FOREIGN PATENT DOCUMENTS

| | | | |
|---|---|---|---|
| 454132 | 12/1927 | Germany | 30/304 |

*Primary Examiner*—John A. Ricci
*Attorney, Agent, or Firm*—Patrick J. Walsh

[57] ABSTRACT

A device for grooming game dart flights includes spaced cooperating cutting blades defining a recess for receiving dart flights and for grooming the flights by smoothing or trimming between the blades.

7 Claims, 1 Drawing Sheet

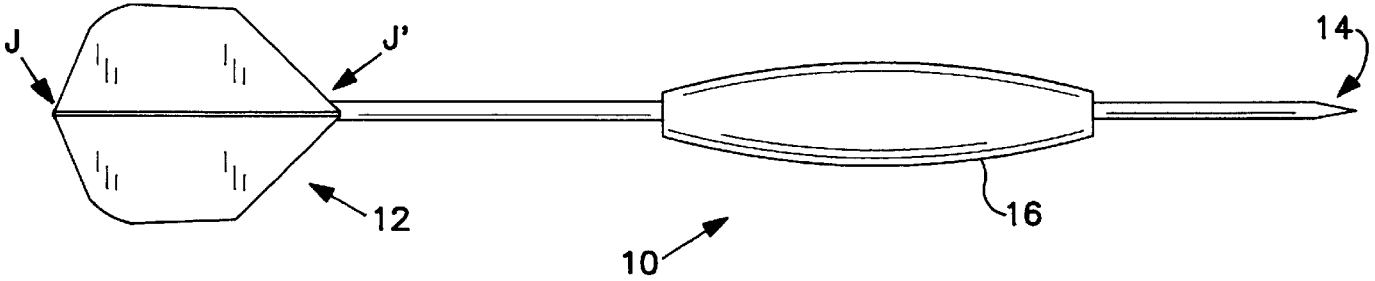
FIG. 1
PRIOR ART
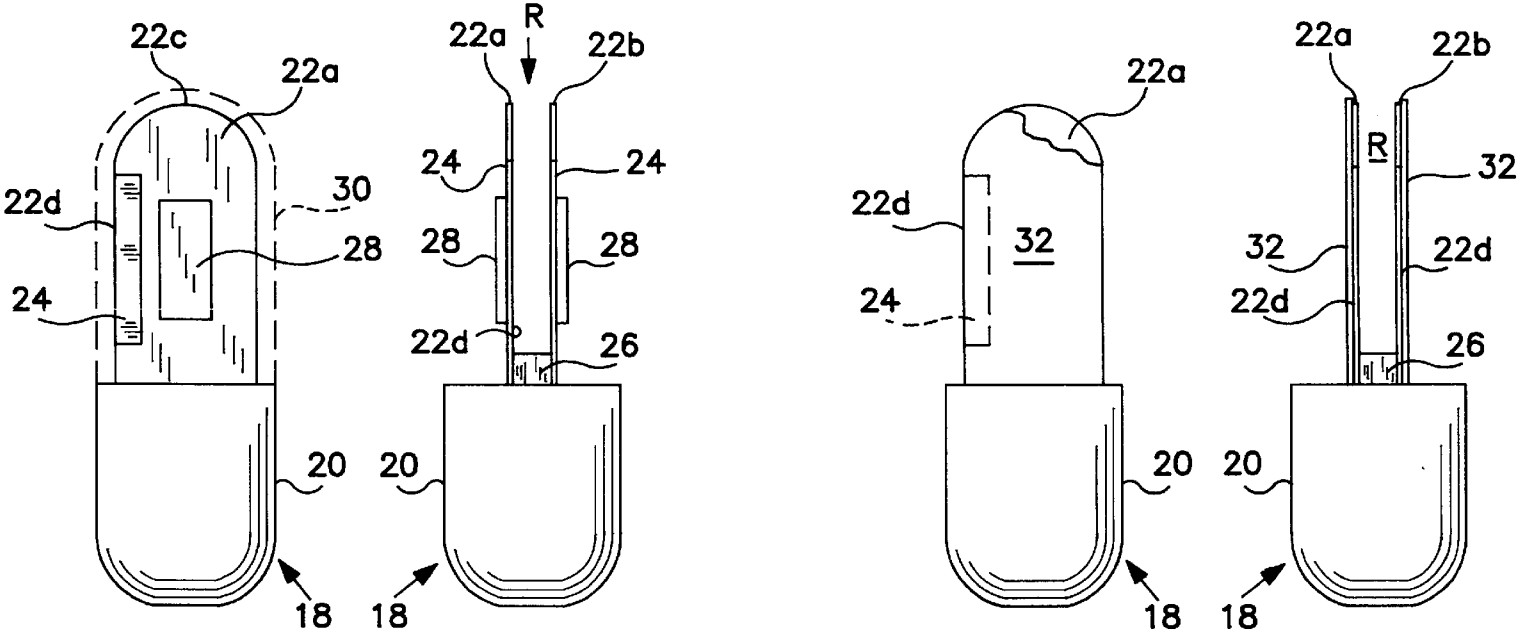
FIG. 2
FIG. 3
FIG. 4
FIG. 5

GAME DART FLIGHT GROOMING DEVICE AND METHOD

BACKGROUND OF THE INVENTION

The present invention relates to game darts and particularly to a device for grooming game dart flights.

A game dart is essentially a hand thrown fin stabilized projectile usually fabricated of a composite of tungsten alloy, wood, plastic or brass, fitted with a sharp point at the projectile tip, and fitted with replacable flights or feathers functioning as fins at the projectile base. The flights are usually fabricated of synthetic material.

In repeated use of a set of darts, the flights sustain nicks and notches and other distortions which are detrimental to flight accuracy of the dart, and useful life of the flights. Such damage is caused by impact by other dart points in play.

This invention provides a device for grooming dart flights so as to reduce or remove distortions sustained by the flights in ordinary play thereby restoring dart accuracy and extending useful flight life.

SUMMARY OF THE INVENTION

A dart flight grooming device according to the invention comprises a hand-held double bladed tool for shaving off and smoothing nicks and notches or other distortions occurring in dart flights. The device includes a base or handle, a pair of cooperating, laterally spaced blades extending longitudinally from the handle, and cooperating finger grips mounted on the handle to extend along the outer face of each blade.

The spaced blades define a flight receiving recess along their inner faces for receiving and smoothing or trimming damaged flights.

Flights are groomed by sliding an edge of the flight into the recess between the blades, pinching the blades together with the finger grips, and drawing the blades over the flight. Grooming may be aided by slightly twisting the flight as the blades are drawn over the flight.

Repair of the flights is accomplished in two ways: (a) the nicks or cuts on a flight are repaired or smoothed by the pressure applied by the finger grips as the blades are drawn over the flight, and (b) the cutting edges of the blades are utilized in cases of more severe damage when a small portion of the flight must be trimmed away to improve the flight surface. Such trimming away is achieved by the twisting action described above.

OBJECTS OF THE INVENTION

An object of the invention is to provide a game dart grooming tool.

Another object of the invention is to provide a game dart flight grooming tool for smoothing and trimming flights to the extent necessary to maintain flight accuracy of a dart.

Another object of the invention is to provide a game dart grooming tool comprising spaced grooming blades wherein the flights are smoothed by confronting blade faces and trimmed as necessary by cooperating blade edges.

Other objects of the invention will become apparent with an understanding of the following detailed description of the invention or upon employment of the invention in practice.

A preferred embodiment of the invention has been chosen for purposes of detailed description and is shown in the accompanying drawing in which:

FIG. 1 illustrates a game dart.

FIG. 2 is a front elevational view of a preferred embodiment of a game dart groomer according to the invention.

FIG. 3 is a side elevational view of the game dart groomer of FIG. 2.

FIG. 4 is a front elevational view of a modified embodiment of a game dart groomer according to the invention.

FIG. 5 is a side elevational view of the game dart groomer of FIG. 4.

DETAILED DESCRIPTION OF THE PREFERRED EMBODIMENT

Referring to the drawing, a game dart 10 is fitted with cruciform stabilizing flights 12 usually made of metallic foil, mylar, polyethylene or nylon rib stock. The dart comprises an elongate body with a sharp tip 14 and a main body 16 of tungsten alloy or similar material.

In use during a dart game, incoming darts can inflict nicks on the flights of landed darts particularly where darts are aimed for landing in a small target area of a dartboard.

A game dart grooming device 18 for repairing such nicks comprises a handle or base 20 mounting spaced blades 22*a*, 22*b* which preferably diverge at a shallow angle. The blades are spaced apart a distance sufficient to define a dart flight receiving recess R for grooming flights. Typical spacing is 0.5 mm–4 mm. Each blade is fabricated of spring steel, for example, and sharpened along bevelled side edges 24 to a sharp edge 22*d* for trimming flights. The top edges 22*c* of each blade are blunt to avoid damaging the spine junction of flight J and dart body J'. If desired a blade spacer 26 may be installed at the base of the recess between blades.

The outer surfaces of the blades may be fitted with finger pads 28 for applying pressure to the lateral faces of the blades in the course of trimming or smoothing a flight.

For protection, a closure cap 30 may be fitted to the base for covering the blades when not in use.

In a modified embodiment shown in FIGS. 4 and 5, protective shields 32 are positioned along the outer surfaces of the blades and in covering relationship to the sharp cutting edges 22*d* which are now accessible only from within the recess. The shields also serve as finger pads for applying lateral pressure to the blades for trimming flights.

In use, flight repair is accomplished by smoothing nicks or cuts by application of pressure by the finger grips as the blades are drawn over the flight. In addition, the cutting edges of the blades are utilized in cases of more severe damage when a small portion of the flight must be trimmed away to improve the flight surface. Such trimming away is achieved by drawing the tool over a flight and slightly twisting the flight.

The modified embodiment of the invention is used in the same way. In addition, the modified embodiment with edges protected, can be held in one hand during a dart match for grooming a dart prior to throw.

Various changes may be made to the structure embodying the principles of the invention. The foregoing embodiments are set forth in an illustrative and not in a limiting sense. The scope of the invention is defined by the claims appended hereto.

I claim:

1. A device for grooming dart flights comprising a handle, a pair of cooperating, spaced blades extending longitudinally from the handle, each blade mounted to the handle and having outer and inner faces, upstanding side edges, and a top edge, the spaced blades defining a flight receiving recess along their inner faces for receiving and smoothing or trimming damaged flights, each of the blades having at least one side edge bevelled to a cutting edge so that a flight is groomed as it passes through the recess, and the outer surfaces of the blades being fitted with pads for applying inward pressure moving the blades to engage a flight occupying the recess.

2. A device as defined in claim 1 which further includes a removable protective cap for the blades.

3. A device as defined in claim 1 in which each blade top edge is blunt.

4. A device as defined in claim 1 in which the blades are spaced 0.5 mm to 4 mm apart.

5. A device for grooming dart flights comprising a handle, a pair of cooperating, spaced blades extending longitudinally from the handle, each blade mounted to the handle and having outer and inner faces, upstanding side edges, and a top edge, the spaced blades defining a flight receiving recess along their inner faces for receiving and smoothing or trimming damaged flights, each of the blades having at least one side edge bevelled to a cutting edge so that a flight is groomed as it passes through the recess, and the outer surfaces of each blade and cutting edge being covered by a shield.

6. A method for grooming nicks from the flights of game darts utilizing a device having a handle mounting confronting grooming blades having inner and outer faces, with the blades spaced apart to define a flight receiving recess, and with the blades having a sharp edge, comprising the steps of:

a. positioning a dart flight in the recess between the blades, b. applying pressure directly to the outer faces of the blades so that their inner faces engage the surface of the dart flight, and c. while maintaining the applied pressure, drawing the inner faces of the blades over the flight to smooth nicks.

7. The method of claim 6 which further includes the step of cutting away damaged portions of a flight by drawing the the sharp edge through the damaged portion while slightly twisting the flight.

* * * * *